United States Patent [19]

Mausteller et al.

[11] Patent Number: 4,754,751

[45] Date of Patent: Jul. 5, 1988

[54] ESCAPE RESPIRATOR

[75] Inventors: John W. Mausteller, Evans City; Daniel L. Thiebaud, Zelienople; Miles J. McGoff, Wexford, all of Pa.

[73] Assignee: Mine Safety Appliances Company, Pittsburgh, Pa.

[21] Appl. No.: 62,097

[22] Filed: Jun. 11, 1987

[51] Int. Cl.[4] ..... A62B 19/00

[52] U.S. Cl. ..... 128/201.25; 128/205.28

[58] Field of Search ..... 128/201.25, 202.27, 128/205.12, 205.17, 205.28

[56] References Cited

U.S. PATENT DOCUMENTS

| | | | |
|---|---|---|---|
| 2,048,059 | 7/1936 | De Boademange | 128/201.25 |
| 4,231,359 | 11/1980 | Martin | 128/205.17 X |
| 4,365,628 | 12/1982 | Hadel | 128/205.12 |
| 4,461,291 | 7/1984 | Mascher et al. | 128/205.12 X |
| 4,614,186 | 9/1986 | John | 128/201.25 |

FOREIGN PATENT DOCUMENTS

| | | | |
|---|---|---|---|
| 2504881 | 9/1975 | Fed. Rep. of Germany | 128/202.27 |
| 2164570 | 3/1986 | United Kingdom | 128/205.28 |

*Primary Examiner*—A. Michael Chambers
*Assistant Examiner*—John C. Fox
*Attorney, Agent, or Firm*—Reed Smith Shaw & McClay

[57] ABSTRACT

A self-contained emergency respirator that has a mouthpiece that fits into a wearer's mouth and which is directly connected to a chemical canister that processes exhaled breath. The mouthpiece is located within a transparent hood that completely surrounds the head of a wearer and protects the wearer from a possibly toxic environment. A breathing bag encloses the chemical canister and collects the processed exhaled breath for inhalation.

7 Claims, 4 Drawing Sheets

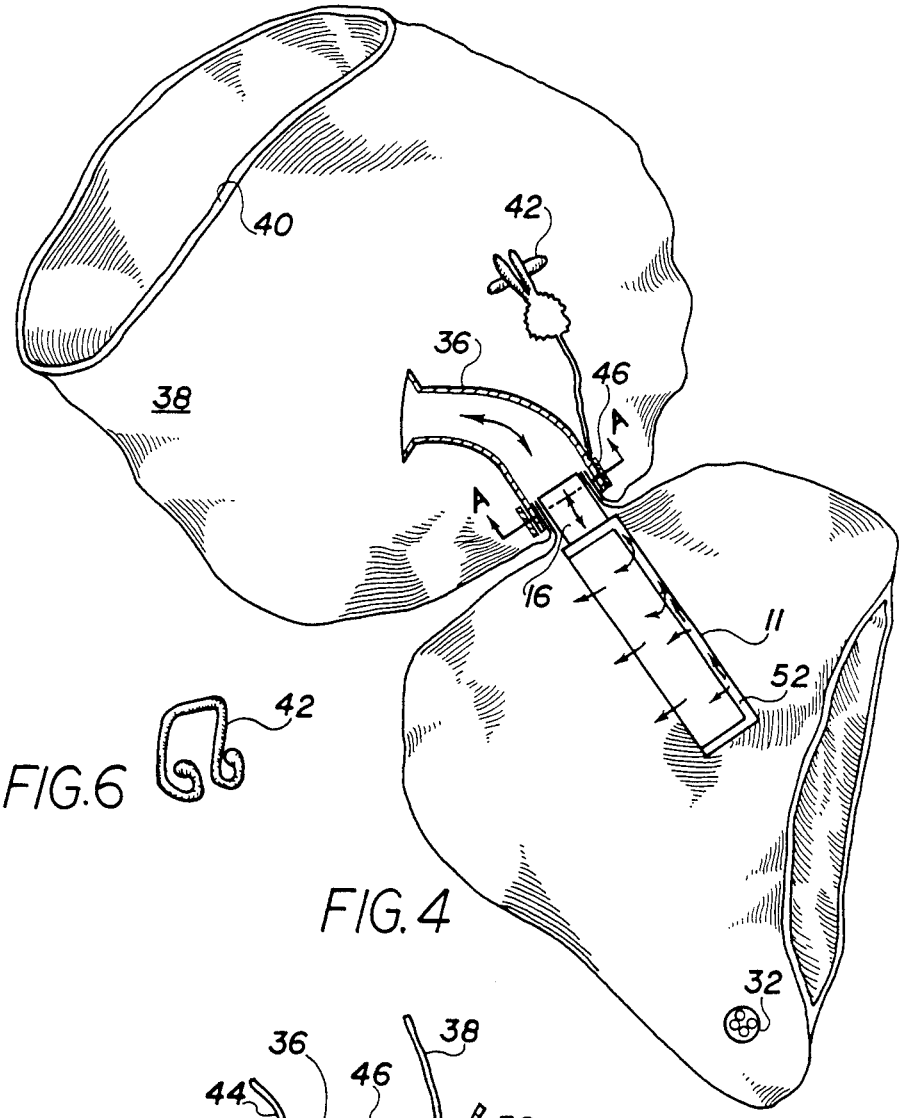
FIG.6
FIG. 4
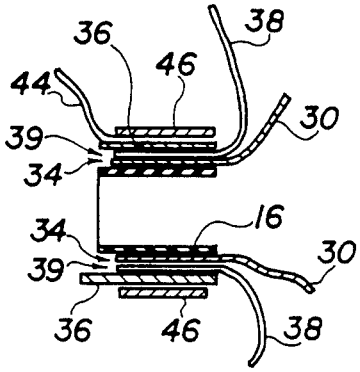
A-A FIG. 5

ESCAPE RESPIRATOR

FIELD OF THE INVENTION

The present invention relates to emergency escape respirators. More specifically, the present invention relates to emergency self-contained escape respirator apparatus that maintains a wearer's visual integrity.

BACKGROUND OF THE INVENTION

There exist many situations where emergency respirator apparatus are desired, if not necessary. For instance, miners or firemen are constantly exposing themselves to circumstances where the risk of a toxic atmosphere exists. With only a moment's notice, it may be necessary for miners or firemen to extricate themselves from a position where deadly gases and visually irritating or damaging fumes are present.

Many emergency respirators or masks, currently on the market, fail to provide adequate protection from deadly gases and visually damaging fumes present in the atmosphere. In addition, many of these emergency respirators are complex to manufacture and complex in design.

In U.S. Pat. No. 2,852,023 to Hamilton, et al., there is shown a pendulum breathing-type escape apparatus having a mouthpiece supporting a $KO_2$ type canister and a breathing bag. The canister is not contained inside the breathing bag, but in series with the mouthpiece and the breathing bag. An oxygen charge supplements the oxygen produced by the chemical processing of the exhalation breath through the canister. There is no hood disclosed to protect the vision of a wearer if the circumstances require it.

U.S. Pat. No. 3,893,459 to Mausteller, et al. discloses an emergency breathing apparatus that uses circuitous breathing. A breathing bag is attached to one end of a chemical cartridge to receive processed exhalation. A mask with a breathing opening fits over the nose and mouth and possibly over the face of a wearer. The breathing opening communicates with a check valve surrounded by a perforated wall. Exhalation passes through the breathing opening and through the perforated wall into the chemical to be processed. After processing it collects in the breathing bag. The oxygen is then inhaled from the bag through the check-valve, which opens for inhalation, and through the breathing tube into the mouth or nose of a user.

U.S. Pat. No. 4,411,023 to Dinson discloses a smoke protective hood for protecting a wearer from poisonous fumes. The hood is not self-contained and no breathing bag is utilized. The protection offered by the mask is limited to toxic gases that are absorbed by materials such as coconut charcoal, silica and almondine. These materials fit into the mask itself at a location before the mouth of the user.

SUMMARY OF THE INVENTION

Accordingly, one object of the present invention is to provide an escape respirator that is self contained and maintains a wearer's visual integrity.

Another object of the present invention is to provide an escape respirator that is easy to manufacture and simple in design.

Another object of the present invention is to provide an escape respirator that is collapsible and fits into a pouch that is carried by a user until an emergency situation arises.

These and other objects of the present invention are attained with an emergency escape respirator that is fitted over the head of a wearer and supported from a mouth thereof when used, comprising: a mouthpiece having a first end and a second end; means for protecting the head of a wearer from toxic fumes, the protecting means surrounding the head of a wearer and having at least a first opening; means for processing exhalation from a wearer into oxygen, the processing means having a nozzle which is attached with the second end of the mouthpiece so exhalation passes through the mouthpiece into the processing means via the nozzle; means for collecting the oxygen, the collecting means surrounding the processing means and having at least a first opening aligned with the first opening of the protecting means so the nozzle of the processing means can be attached with the second end of the mouthpiece, the oxygen collected in the collecting means, upon inhalation by the wearer, passing through the processing means, through the nozzle and into the mouthpiece; and a clamp holding the second end of the mouthpiece and the nozzle in place as well as the protection means and the collecting means at their respective first openings around the second end of the mouthpiece and the nozzle; wherein the protection means and the collection means are capable of being collapsed into a compact form that can easily be carried by a wearer until use.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 4 is a side view of the respirator.

FIG. 5 is a side view of the hood-breathing bag assembly.

FIG. 6 is a view of the noseclip.

DESCRIPTION OF THE PREFERRED EMBODIMENT

Figure 1:
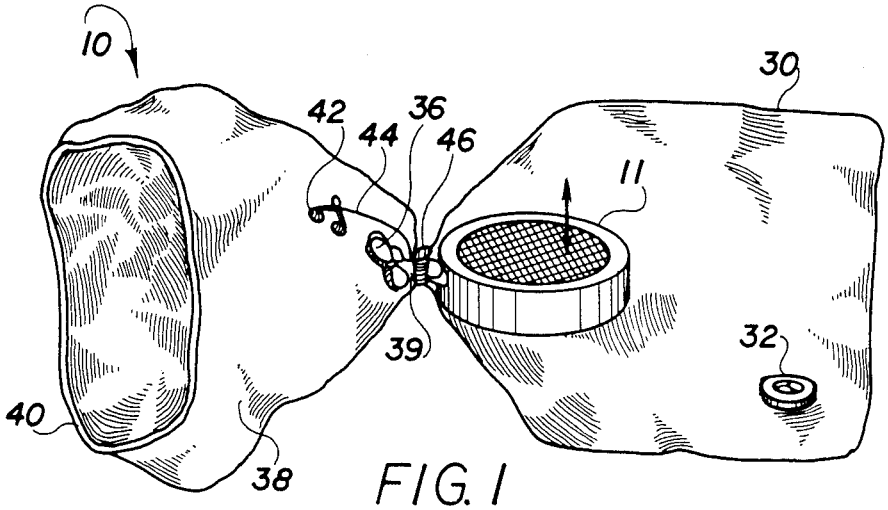
FIG. 1 is an overhead view of the respirator.

Referring now to the drawings, wherein like reference numerals designate identical or corresponding parts through the several views, and more particularly to FIG. 1 thereof, a chemical air regeneration escape respirator 10 is shown. The respirator 10 is comprised of a transparent hood 38 that fits over a user's head during emergency situations where the surrounding atmosphere is toxic. A mouthpiece 36 in the hood 38 is received in the mouth of the user and a noseclip 42 is clamped onto the nose of the wearer so inhalation and exhalation will occur through the mouthpiece 36. Also attached to the mouthpiece 36 at the end not in the user's mouth is a chemical canister 11 that converts exhaled breath to oxygen. A hood hole 39 allows the mouthpiece to pass therethrough and communicates with the canister 11. Completely enclosing the canister 11, except for bag opening 34 through which the mouthpiece 36 fits, is a breathing bag 30 in which the processed breath and oxygen collects so it may be subsequently inhaled. Any excess pressure in the bag 30 is alleviated by a vent valve 32. Upon inhalaton, the oxygen and processed breath in the bag 30 returns to the user by retracing the path the exhaled breath followed via the mouthpiece 36 and the canister 11. the canister 11, mouthpiece 36, hood 38 and bag 30 are held in place by a clamp 46.

Figure 2:
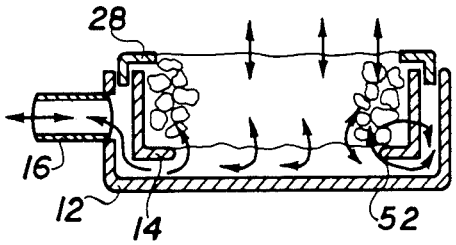
FIG. 2 is a cross-sectional view of the canister.
Figure 3:
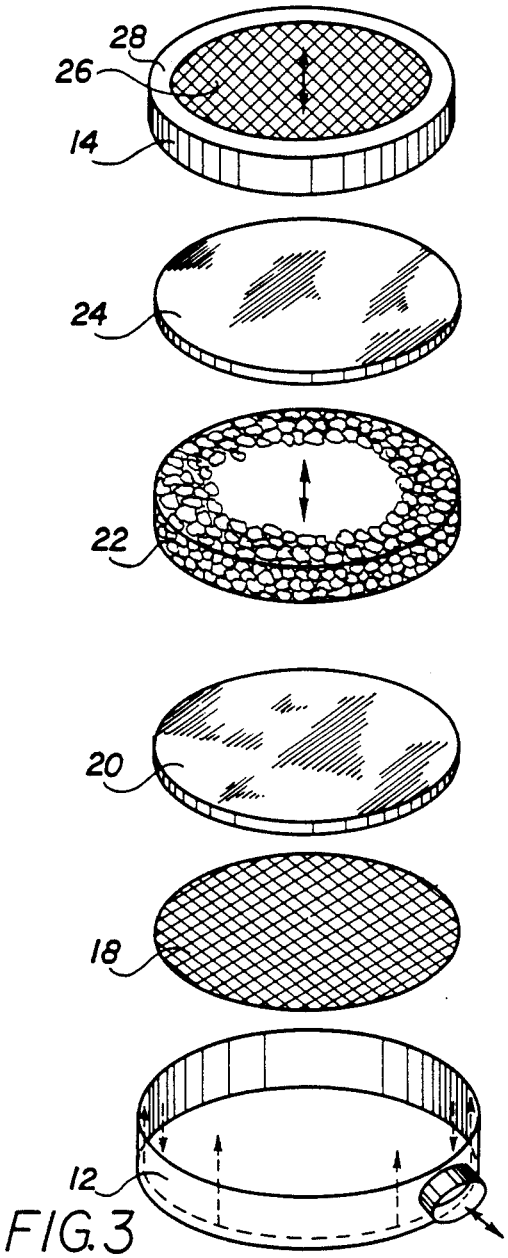
FIG. 3 is a schematic diagram of the canister.

More specifically, and referring to FIG. 3, in the escape respirator 10, an outside shell 12 houses an inside shell 14. The outside shell 12 is open on the top with a circumferential wall and a solid back. The outside shell 12 and inside shell 14 may be of tinplate or an equivalent material with the inside shell 14 having a 3.6 inch O.D. and the outside shell having a 3.75 I.D. (Note: the minimum diameter of the canister to meet Code of Federal Regulations (CFR) 30, Part 11, Table 1; Man test 1 is 3⅛ diameter). The outside shell 12 has a nozzle 16 through which exhaled air or oxygen may pass. Preferably the nozzle 16 is elliptical and rimmed for better gripping. Inside shell 14 has a circumferential wall which is flanged along the base, as can be better seen in the cross sectional view of the canister assembly 11 shown in FIG. 2. Referring back to FIG. 3, a first screen 18 fits inside the inside shell 14 and rests upon the flange of the inside shell 14. A first mat filter 20, preferably made of fiberglass or equivalent material fits into the inside shell 14 and rests atop first screen 18. A chemical processing material 22, for example, $KO_2$, fits into the inside shell 14. If $KO_2$ is used, it can be, for instance, 70–80 Gram 6–10 mesh. A second mat filter 24, also possibly made of fiberglass or equivalent fits into the inside shell 14 atop the chemical processing material 22.

A second screen 26 fits inside a cap 28 that has circumferential walls and is flanged at the top (see FIG. 2). The second screen 26 fits into the flanged area of cap 28 and is held snugly therein. The cap 28 with the second screen 26 is placed over the inside shell 14 and rests atop the circumferential walls of the inside shell 14, sealing the top opening of inside shell 14. It should be noted that the first screen 18, the first mat filter 20, the chemical processing material 22, the second mat filter 24 and second screen 26, all of which fit in the inside shell 14 and cap 28 should be of the same planar shape and completely fill the space between the inside shells circumferential wall. This is necessary to prevent any fluid passing through the inside shell 14 and cap 28 from not passing through each of the above-listed layers and be fully processed, as is described below.

The inner shell 14 fits into the outer shell 12 as shown in FIG. 2. The inner shell 14 does not rest on the closed bottom of the outer shell but a small distance above the closed bottom of the outer shell 12. This is to allow fluid to flow through the first screen 18 and enter or leave the inner shell 14. The inner shell 14 is supported off the bottom of outer shell 12 by the cap 28 of the inner shell 14 fitting tightly against the top of the circumferential wall of the outer shell 12. The tight fit of the cap 28 against the top of the circumferential wall of the outer shell 12 also serves the purpose of sealing the fluid passage that fans under and around the periphery of the inner shell 14 (due to the inner shell 14 being smaller and shallower than the outer shell 12) so fluid entering or leaving the canister assembly 11 must go through the nozzle 16 or the inner shell 14 and cap 28 structure. Preferably, the overall canister assembly thickness is 1.2 inches.

The canister assembly 11 is situated in a breathing bag 30 as shown in FIGS. 3 and 4. The breathing bag 30 should be loose fitting around the canister assembly 11 and spacious enough so fluid easily flows through the canister assembly and there is enough volume to an adequate oxygen supply to sustain life during use in emergency situations. Preferably, the breathing bag 30 should be made of urethane film that is about 3 mils thick and which holds approximately 3 liters of fluid. Additionally, the breathing bag 30 has a vent valve 32 that allows fluid to escape from the bag 30 when the pressure therein goes above a desired level. This prevents the user from having to strain during exhalation if the bag 30 is already inflated and the pressure in the bag 30 is equal to or greater than the pressure that can be applied by the user to exhale.

The breathing bag has a hole 34 through which the nozzle 16 protrudes and communicates with a mouthpiece 36. The mouthpiece 36 fits securely and sealingly over the nozzle 16. Preferably, the mouthpiece 36 is a bite mouthpiece made of rubber. The mouthpiece 36 is located within a hood 38 that is large enough to fit over the head of a user to protect the user from a harsh environment. The mouthpiece penetrates the hood 38 through a hood hole 39 to contact the nozzle 16. The hood should be of a transparent material so the user can see through it. In addition, the base of the hood has an elastic opening 40 that allows the user to draw the hood over the user's head and seal around the user's neck. Alternatively, a draw string can be situated around the hood opening 40 that can be drawn tight around the user's neck. Preferably, the hood is of a clear mylar material about 1 mil thick and the hood opening 40 is defined with silastic edging. Also located in the hood is a noseclip 42 which a user clamps on his nose so only fluid from the mouthpiece 36 is inhaled. The noseclip 42 is attached to the hood by a noseclip cord 44. Preferably a swimmer's type noseclip 42 is used, as shown in FIG. 6.

The breathing bag 30, nozzle 16, mouthpiece 36, hood 38 and noseclip cord 44 are held together by a clamp 46 as shown in FIG. 5. FIG. 5 is a cross sectional view of section A—A shown in FIG. 4. The nozzle 16 is located inside the breathing bag hole 34 with the area of the breathing bag 30 defining the breathing bag hole 34 and the material near the hole running essentially the length of the nozzle 16. The nozzle 16 surrounded by the bag hole 34 material is in turn surrounded by hood hole 39 material. The material forming hood hole 39 is in an inverted position as it surrounds the bag hole 34 material and nozzle 16. Next, the mouthpiece opening 48 fits over and surrounds the above mentioned layers. The end of the noseclip cord 44 is situated along the outside of the part of the mouthpiece 36. The clamp 46 squeezes the cord against the mouthpiece 36, holding it in place, as well as holding all the other identified parts in place.

By the canister assembly 11, through the nozzle 16, being secured directly to the mouthpiece 36, the need for a hose connector, as typically found in the prior art, is eliminated. Moreover, the canister assembly 11 and mouthpiece structure are materially supportive, allowing the canister assembly 11 to remain remote from the surface of the bag 34 and off or the chest of the user. This is important since the chemical reaction of exhaled air with the chemical processing material may produce a lot of heat that, through conduction could burn a user. By the canister assembly 14 being remote from the chest of the user, the first mat filter 20 as well as the second mat filter provide heat transfer properties, as is well known in the art, that remove much of the heat generated by the chemical reaction. This cooling is augmented by the canister assembly being cooled by fluid in the bag surrounding it on all sides, rather than on one side if it were resting on the chest of a user. The oxygen supplied to the user is thus cooled enough so the user can comfortably inhale it. Additional cooling can be obtained by placing copper mesh in the end space between the inner can 14 and outer can 12.

Figure 7:
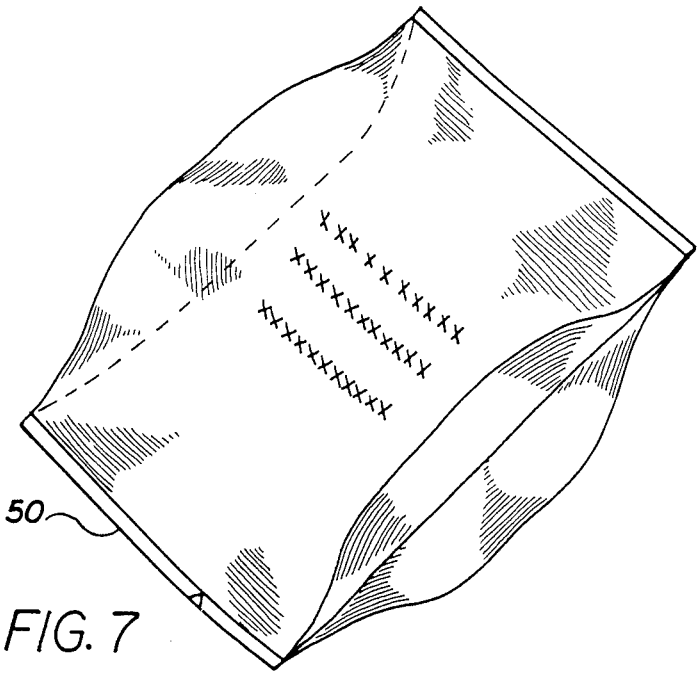
FIG. 7 is an overhead view of the carrying pouch.

In the operation of the invention, the respirator 10 is first broken out of its carrying pouch 50, shown in FIG. 7. The pouch 50 can be, for instance, made of Marvelseal 580 Pouch material and with a preferred size of 4½ inches by 4 inches and an opening of about 1¼ inches for the respirator 10 to slide in and out. The pouch 50 is carried on the person of the user. Then, the hood 38 is pulled back over the canister and breathing bag so the mouthpiece 36 can be gripped and the noseclip 42 clamped onto the nose. The hood 38 is next pulled back over the head of the user with the elastic hood opening 40 seating itself around the user's neck. Close proximity of the canister assembly 11 to the warm breath of the user from the mouthpiece 36 promotes rapid reaction for processing of the exhaled breath in the canister assembly 11.

In the canister assembly 11 pendulum breathing occurs. As shown in FIG. 2, exhaled breath passes through the nozzle 16, under the inner shell 14, via an annular plenum 52, preferably 0.075 inches thick, up through the first screen 18 the first mat filter 20 where cooling occurs, through the chemical processing material 22 where the $CO_2$ in the breath is removed and replaced with $O_2$, through the second net filter 24 where cooling occurs, through the second screen 26 and finally into the breathing bag 30. Upon inhalation, the entire process is repeated, but in reverse order than described above, with the fluid in the bag 30 being drawn through the inner shell 14 and up into the nozzle 16. During inhalation a second opportunity for processing of the exhaled breath occurs. Ideally, the escape respirator 10 lasts for five minutes at a moderate work rate and weighs 0.7 lb. This light weight allows the respirator to be supported by the gripping mouthpiece 36. It has a long shelf life and has no leakage of oxygen. The following table describes thirteen tests that were carried out with the respirator 10. Each test includes the time elapsed during the test, what activity occurred by the user during that time, the percent $O_2$ and percent $CO_2$ in the processed breath and remarks concerning the test.

| | Canister | | | | | | Test | $O_2$ Conc. (%) | | CO Conc. (%) | | Initial |
|---|---|---|---|---|---|---|---|---|---|---|---|---|
| Test No | Dia. (in.) | Bed Depth (in.) | Wt. (gm) | Mesh | Type | Test Method | Time (min) | (1 min) | 5 min. or End | 1 Min. | 5 Min. | Temp. (End) (°F.) |
| 1 | 3¾ | ¾ | 80 | ¼–4 | Cat. $(KO_2)_2$ | Man, Step up-down 30 min, alter.min. | 3 | 21 | — | 2.5 | — | — |
| 2 | 3¾ | ¾ | 80 | ¼–4 | Cat. $(KO_2)_2$ | Standing, no stepping | 5 | 23 | 41 | 1.5 | 1.6 | — |
| 3 | 3¾ | ¾ | 85 | ¼–4 | Cat. $(KO_2)_2$ | 0–1½ min standing; 1½–3 min step up, step down | 3½ | 31 | 44 | 2.1 | 4.0 | — |
| 4 | 3¾ | ¾ | 85 | ¼–4 | Cat. $(KO_2)_2$ | Standing: few step up: step down | 5 | 24 | 41 | 0.9 | 1.7 | — |
| 5 | 3¾ | ¾ | 90 | ¼–4 | Cat. $(KO_2)_2$ | CFR30° Part II, Tbl 4; Man Test 4 | 2½ | 19.7 | 25 | 4.4 | 5.5 | — |
| 6 | 3¾ | ¾ | 95 | ¼–4 | Cat. $(KO_2)_2$ | CFR30° Part II, Tbl 1; Man Test 1, 3 mph walk | 4 | 26.1 | 38 | 1.5 | 4.0 | 125 |
| 7 | 3¾ | ¾ | 95 | 4–6 | Cat. $(KO_2)_2$ | CFR30° Part II, Tbl 1; Man Test 1, 3 mph walk | 5 | 26.2 | 49.6 | 0.4 | 3.73 | 138 |
| 8 | 3¾ | ¾ | 93 | 6–10 | Cat. $KO_2$ | CFR30° Part II, Tbl 1; Man Test 1, 3 mph walk | 6 | 32.5 | 65.0 | 0.1 | 0.2 | 135 |
| 9 | 3¾ | ¾ | 95 | 6–10 | Cat. $KO_2$ | CFR30° Part II, Tbl 1; Man Test 1, 3 mph walk | 4 | 35.9 | 64.2 | 0.14 | 0.17 | 104 |
| 10 | 3¾ | ⅝ | 70 | 6–10 | Cat. $KO_2$ | CFR30° Part II, Tbl 1; Man Test 1, 3 mph walk | 7 | 37.7 | 63.3 | 0.04 | 0.07 | 127 |
| 11 | 3⅛ | ¾ | 63 | 6–10 | Cat. $KO_2$ | CFR30° Part II, Tbl 1; Man Test 1, 3 mph walk | 6 | 37.3 | 52.5 | 0.13 | 0.21 | 139 |
| 12 | 2¾ | ⅞ | 66 | 6–10 | Cat. $KO_2$ | CFR30° Part II, Tbl 1; Man Test 1, 3 mph walk | 5 | 32.2 | 52.8 | 0.12 | 1.05 | 140 |
| 13 | 2¾ | ⅞ | 66 | 6–10 | Cat. $KO_2$ | CFR30° Part II, Tbl 1; Man Test 1, 3 mph walk | 6 | 28.1 | 53.2 | 0.17 | — | 129(5) |

| | Chemical Analysis | | | | | Breathing | |
|---|---|---|---|---|---|---|---|
| Test No | Avail. $O_2$ (Liter) | Gen'd. $O_2$ (Liter) | Abs. $CO_2$ (Liter) | Chem. RQ | $O_2$ Eff. (%) | Resist. (in. $H_2$) | Remarks |
| 1 | — | — | — | — | — | — | 3.8% $CO_2$ at 3 min, gas samples taken at bag. Mouthpiece not directly attached to canister. |
| 2 | — | — | — | — | — | — | Gas sampling at breathing bag. Inhalation $CO_2$ conc. are lower than bag concentrations. |
| 3 | — | — | — | — | — | — | Canister attached directly to mouthpiece. |
| 4 | — | — | — | — | — | — | Gas samples taken at mouthpiece w/syringe; $CO_2$ conc. ½ that in bag. |

-continued

| | | | | | | | |
|---|---|---|---|---|---|---|---|
| 5 | 19.4 | 6.4 | 3.2 | 0.50 | 33 | — | Test stopped at 2½ min. High $CO_2$. Test too strenuous for canister. High Inhal. temp. |
| 6 | 21.6 | 8.8 | 4.5 | 0.52 | 41 | 2 | 4% $CO_2$ conc. at 4 min. Test stopped. |
| 7 | 21.4 | 9.4 | 3.9 | 0.42 | 41 | 2 | Smaller mesh $KO_2$ improved performance. |
| 8 | 19.4 | 10.4 | 4.1 | 0.40 | 66 | 2–2½ | Cat. 6–10 mesh $KO_2$ showed further improvement. |
| 9 | 20.3 | 10.4 | 4.1 | 0.40 | 52 | 2½ | In-line mouthpiece detaches from canister. Lowers Inhal. temp. |
| 10 | 15.8 | 14.8 | 5.4 | 0.37 | 94 | 2 | Reduced $KO_2$ by dec. bed thickness. |
| 11 | 14.2 | 13.0 | 4.8 | 0.37 | 92 | 2–2½ | Reduced $KO_2$ by dec. diameter. |
| 12 | 14.6 | 10.6 | 4.0 | 0.38 | 72 | 3½–5 | Reduced $KO_2$ by dec. bed dia. 2¾" dia too small. Need at least 3⅛" dia can. |
| 13 | 14.8 | 15.6 | 5.1 | 0.38 | 92 | 3½–4 | Copper mesh heat sink lowers inhal. temp. about 10° F. |

Obviously, numerous (additional) modifications and variations of the present invention are possible in light of the above teachings. It is therefore to be understood that within the scope of the appended claims, the invention may be practiced otherwise than as specifically described herein.

What is claimed is:

1. An emergency escape respirator that is fitted over the head of a wearer and supported from a mouth thereof when used comprising:

a mouthpiece having a first end and a second end;

means for protecting the head of a wearer from toxic fumes, said protecting means surrounding the head of a wearer and having at least a first opening;

means for processing exhalation from a wearer into oxygen, said processing means having a nozzle which is attached with the second end of the mouthpiece so exhalation passes through the mouthpiece into the processing means via the nozzle;

means for collecting the oxygen, said collecting means surrounding the processing means and having at least a first opening aligned with the first opening of the protecting means so the nozzle of the processing means can be attached with the second end of the mouthpiece, the oxygen collected in the collecting means, upon inhalation by the user, passing through the processing means, through the nozzle and into the mouthpiece; and a clamp holding the second end of the mouthpiece and the nozzle in place and holding the protection means and the collecting means at their respective first openings around the second end of the mouthpiece and the nozzle; wherein the protecting means and the collecting means are capable of being collapsed into a compact form that can easily be carried by a wearer until use.

2. An escape respirator as described in claim 1 wherein the protecting means is a transparent flexible hood that is large enough to fit over the head of a wearer, said hood having a first opening that allows the second end of the mouthpiece to communicate with the nozzle, said hood having a second opening whose size can be varied, said second opening allowing said hood to be pulled over the wearer's head.

3. An apparatus as described in claim 2 wherein the collecting means is a flexible breathing bag.

4. An apparatus as described in claim 3 wherein the breathing bag includes a vent valve positioned in and through the breathing bag to allow excess pressure in the breathing bag to be released.

5. An apparatus as described in claim 3 wherein the processing means is a canister containing a chemical that removes carbon dioxide and generates oxygen, the canister having a nozzle which is attached to the second end of the mouthpiece.

6. An apparatus as described in claim 5 including a noseclip located inside the hood and a noseclip cord attached to the noseclip and held in place by the clamp.

7. An apparatus as described in claim 5 wherein the canister is comprised of an outer shell that has a base and a circumferential wall, with the nozzle opening out from the circumferential wall;

an inside shell enclosed by the outer shell, said inside shell having a circumferential wall that is flanged and a top, said inside shell having an open top face and bottom face between the wall;

inside the inner shell there being a first screen resting on the bottom flange of the wall and covering the open bottom face;

a first mat filter resting on and covering the first screen;

a chemical processing material that removes $CO_2$ and generates oxygen resting on and covering the first mat filter;

a second mat filter resting on and covering the chemical processing material;

a second screen having a first and second side, said first side resting on and across the second mat filter and said second side covering the top face of the inner shell; and a cap that fits on and over the top of the circumferential wall, said cap being open to expose the top face of the inner shell, said cap holding the second screen in place; wherein the inner shell and cap are fitted into the outer shell with the cap held in place at the top of the outer shell so the inner shell, which is smaller than the outer shell, is supported above the base of the outer shell, thus forming an annular plenum for breath to travel from the nozzle down under the inner shell up through the first screen, through the first mat filter, through the chemical processing material, through the second mat filter, and through the second screen into the breathing bag.

* * * * *